US005134865A

United States Patent [19]

Shima et al.

[11] Patent Number: 5,134,865

[45] Date of Patent: Aug. 4, 1992

[54] SINKER MECHANISM FOR FLAT KNITTING MACHINES

[75] Inventors: Masahiro Shima; Masahiro Yabuta, both of Wakayama, Japan

[73] Assignee: Shima Seiki Mfg., Ltd., Wakayama, Japan

[21] Appl. No.: 633,494

[22] Filed: Dec. 26, 1990

[30] Foreign Application Priority Data

Dec. 28, 1989 [JP] Japan ..... 1-344375
Dec. 28, 1989 [JP] Japan ..... 1-344376

[51] Int. Cl.[5] ..... D04B 15/06
[52] U.S. Cl. ..... 66/106; 66/104
[58] Field of Search ..... 66/104, 106

[56] References Cited

U.S. PATENT DOCUMENTS

| | | | |
|---|---|---|---|
| 2,329,617 | 9/1943 | Ingalls | 66/106 |
| 2,762,213 | 9/1956 | Schurich | 66/106 |
| 2,909,049 | 10/1959 | Rees | 66/106 X |
| 3,024,633 | 3/1962 | Kuntz | 66/106 |
| 3,754,416 | 8/1973 | Apprich | 66/106 |

FOREIGN PATENT DOCUMENTS

| | | | |
|---|---|---|---|
| 2430824 | 1/1976 | Fed. Rep. of Germany | 66/106 |
| 3917934 | 12/1989 | Fed. Rep. of Germany . | |

*Primary Examiner*—Werner H. Schroeder
*Assistant Examiner*—John J. Calvert
*Attorney, Agent, or Firm*—Edwin E. Greigg; Ronald E. Greigg

[57] ABSTRACT

A sinker mechanism which includes multiple knitting needles placed in parallel above a needle bed with each sinker being mounted so that it can rock up and down so that its tip descends between adjacent knitting needles. A yarn-catching hook is provided at one sinker end; downward pressure is applied by a spring that can be removed from and replaced into the sinker so the yarn-catching hook will drop between adjacent knitting needles, and this downward force is adjustable so the yarn-catching hook's position is a function of the tension in the yarn it is holding. The sinker is located in the cut-out portion of the needle plate with the capability to rock up and down so that its back end can be linked to the end of the needle plate, and that the plate and is configured so that an arm projects to touch the rear cam. A spacer is provided whose front end is adjacent to the sinker's middle portion when the sinker is joined to the needle plate, and the spacer's back end is joined to the needle plate beside the sinker at a point higher than the knitting needle.

3 Claims, 10 Drawing Sheets

SINKER MECHANISM FOR FLAT KNITTING MACHINES

BACKGROUND OF THE INVENTION

The present invention relates to a sinker mechanism for flat knitting machines.

The sinker mechanisms for flat knitting machines of prior art are characterized in that multiple knitting needles are placed in parallel and have the capability of sliding in and out of the needle bed, and that each sinker is fixed to the needle bed, its tip being located between adjacent knitting needles.

In the prior art, a previously formed loop is held by the sinker, but if the knitting width must be expanded abruptly—during fashioning, for example—a takedown device will pull the narrow-width loop with great force, whereas the force applied to press down the first course of loops is insufficient, resulting in uneven loops.

To remedy this problem, a so-called "waste course" was used so the knitting could be adjusted gradually to the required width. This "waste course" tended to reduce productivity.

German patent application DE 3917934 solved the problem of the "waste course" by making sinkers capable of rocking.

In that patent, the sinker is characterized in that it is J-shaped and supported by a pin in the middle with a press-down part at the end near the knitting needle which positions loops, and with a spring support projecting from one part of the sinker. This spring support allows abrupt widening without going through a "waste course."

However, such a sinker presented the disadvantage of being too high and bulky because its movement is controlled by cams on the carriage and because it has a pin in the middle of the J shape.

In addition, since its spring support is part of the sinker, it is made of the same material as the sinker, and the spring modulus cannot be adjusted. This is a serious defect in a knitting machine designed to produce varieties of patterns. Moreover, since the sinker has a pin in the middle, replacing it is a problem: when the pin is pulled out, the sinker pops out because of its spring support. Installation of the sinker requires substantial time and effort because of this spring support's tendency to pop out the sinker.

The object of the present invention is to provide a sinker mechanism for flat knitting machines that obviates these shortcomings; in addition to improving productivity by eliminating the "waste course" step, it also applies the proper tension to the loops regardless of the type of yarn used.

SUMMARY OF THE INVENTION

To achieve this objective, the sinker mechanism of this invention is characterized in that multiple knitting needles are placed in parallel above the needle bed, each sinker being mounted so that it can rock up and down and that its tip descends between adjacent knitting needles. A yarn-catching hook is provided at one sinker end; downward pressure is applied by a spring that can be removed from and replaced into the sinker so the yarn-catching hook will drop between adjacent knitting needles, and this downward force is adjustable so the yarn-catching hook's position is a function of the tension in the yarn it is holding. It is also characterized in that the thickness of the upper half of the needle plate is reduced by at least the thickness of the sinker, thereby creating a step, that a semicircular concavity is created under this cut-out area, and that the needle plates and knitting needles are mounted in parallel on the needle bed, regularly spaced. This sinker is also characterized in that it has a yarn-catching hook that positions the loop, that it has a contact surface near the hook that touches the front cam, that it has a surface in its middle that rests in the semicircular concavity of the needle plate, and that it has a contact surface at the other end that touches the rear cam. The mechanism is further characterized in that the sinker is located in the cut-out portion of the needle plate with the capability to rock up and down, that its back end can be linked to the end of the needle plate, and that the downward-curving semicircle in the middle of the sinker resting on the needle plate is configured so that an arm projects to touch the rear cam. It is also characterized by a spacer whose front end is adjacent to the sinker's middle portion when the sinker is joined to the needle plate, and the spacer's back end is joined to the needle plate beside the sinker at a point higher than the knitting needle.

The sinker mechanism of the present invention is characterized in that the surface supporting the sinker rests in the semicircular concavity of the needle plate, allowing it to rock up and down, that the sinker's contact surfaces for the rear and front cams cooperate with the respective cams on the moving carriage, and that as the carriage passes, the supporting surface allows the sinker to rock up or down as required, positioning the loop of knitting yarn held by the hook at the front end of the sinker.

At this point, the knitted fabric between the knitting needles held by this hook is pressed down by the wire spring, creating the appropriate tension in the loop at each knitting needle.

By this device, the knitting width can be expanded instantly.

In addition, when the knitting needle is moved forward by the carriage and the tension in the loop to be knocked over is increased, this tension, transmitted by the yarn-catching hook, will cause the sinker to press up against the wire spring, thereby easing the tension.

Thus, no excessive tension is applied to the loop to be knocked over, and the yarn is prevented from stretching or breaking.

In addition, since the sinker rests in the cut-out portion of the needle plate, the knitting needle is located along the sinker and the needle plate, and since the spacer is joined to the needle plate at a point higher than the sinker, it is easy to replace damaged needles underneath the spacer by raising the spacer up on its supporting arm.

BRIEF DESCRIPTION OF THE DRAWINGS

The attached drawings show one embodiment of the present invention.

DETAILED DESCRIPTION OF THE PREFERRED EMBODIMENT

Figure 1:
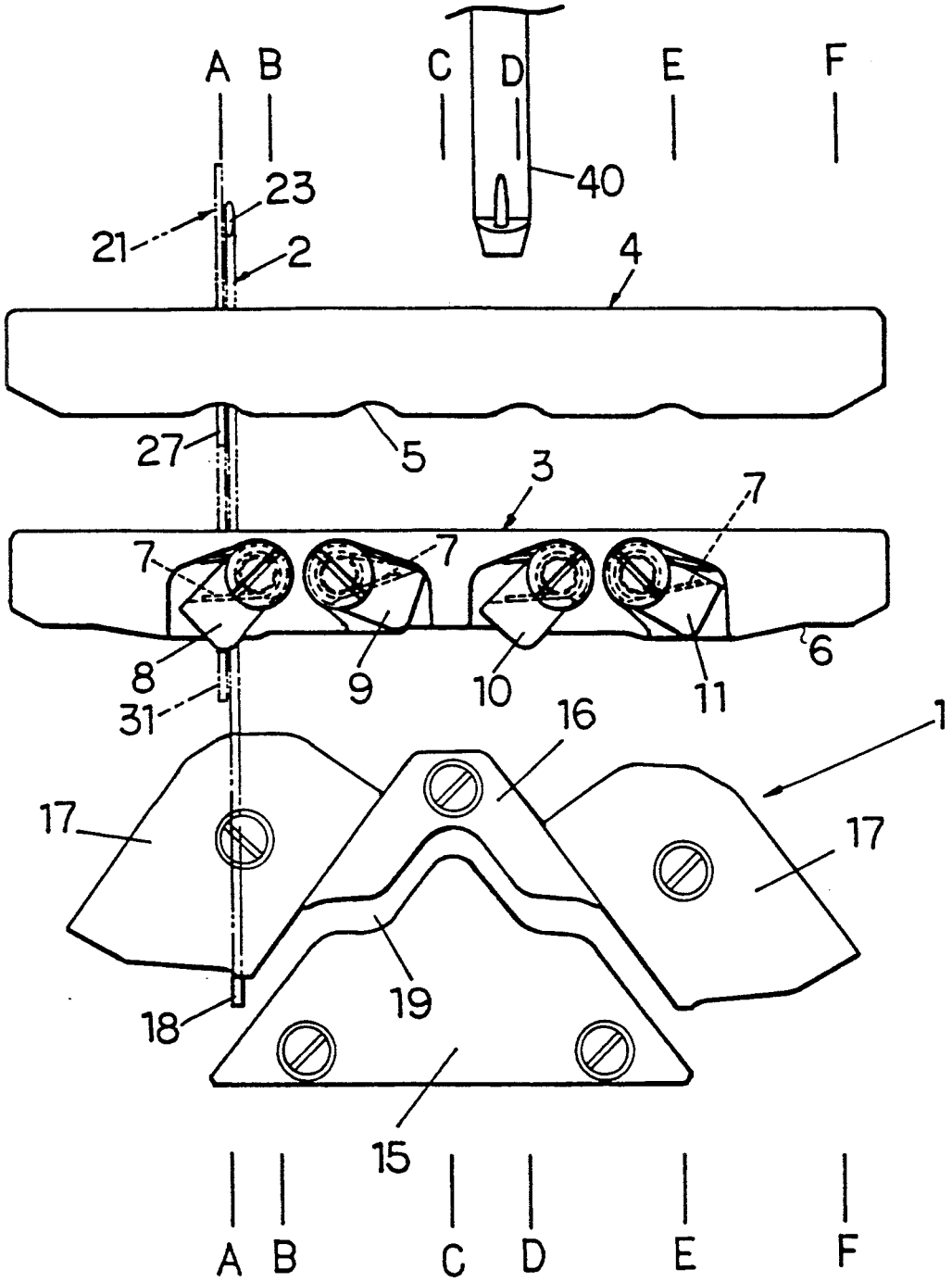
FIG. 1 is an exploded view of a portion of the flat knitting machine carriage that controls the knitting needles and sinkers.

Following is a detailed explanation of the present invention, using the above drawings of the embodiment:

FIG. 1 is a simplified view of the mechanism of the flat knitting machine carriage that controls the knitting needles and sinkers, where (1) is the knitting cam; (3) is a sinker-controlling rear cam located in front of the knitting cam (1); and (4) is a sinker-controlling front cam located in front of the rear cam (3).

The above sinker-controlling front cam (4) has a cam profile (5) on its lower edge; and the sinker-controlling rear cam (3) consists of a cam profile (6) on its lower edge, and movable cams (8), (9), (10) and (11) that are acted on by coiled springs (7) so as to project below the edge of the plate; sinker-controlling front cam (4) and rear cam (3) are secured respectively by bolts (14) and (13) to a bracket (12) that projects from the main body of the carriage (see FIG. 3).

Of these above movable cams (8), (9), (10), (11), cams (8) and (10) are for forward motion, and cams (9) and (11) are for reverse motion.

Knitting cam (1) consists of a triangle-like needle-raising cam (15), another triangle-like cam (16) directly above needle-raising cam (15), and two triangle-like cams (17) sliding on the lateral faces of (16), and a control groove (19), between needle-raising cam (15) and triangles (16) and (17), through which the butt (18) of needle (2) travels as shown in FIG. 1.

Figure 2A:
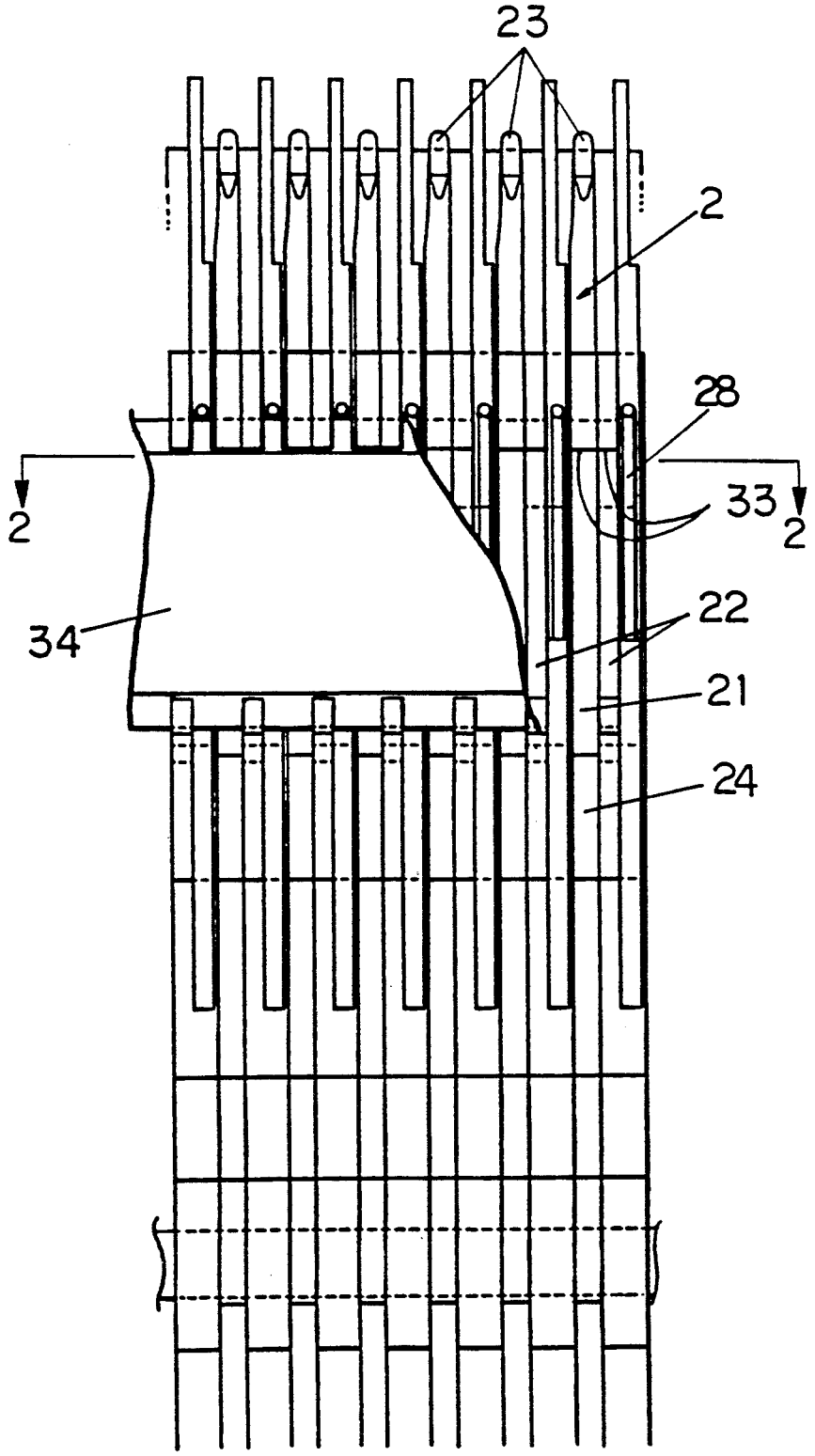
FIG. 2*a* is a top view of the sinker.
Figure 2B:
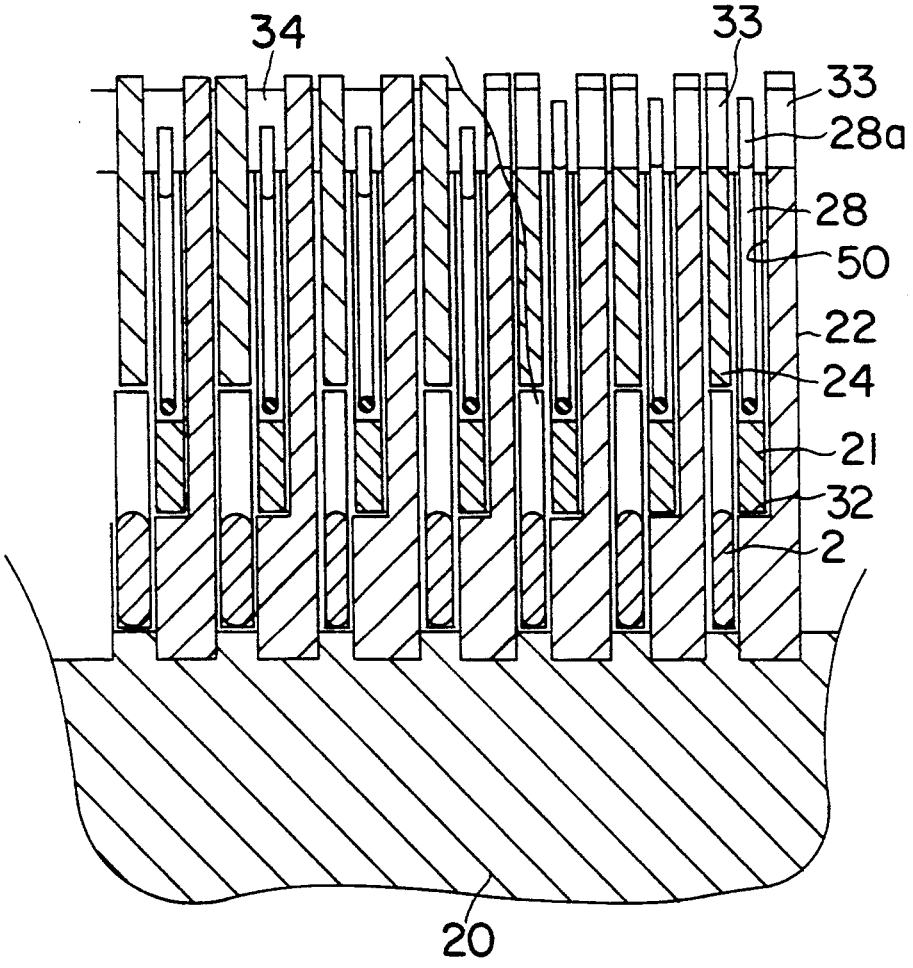
FIG. 2*b* is a cross-sectional view of FIG. 2*a* along line 2—2.
Figure 3:
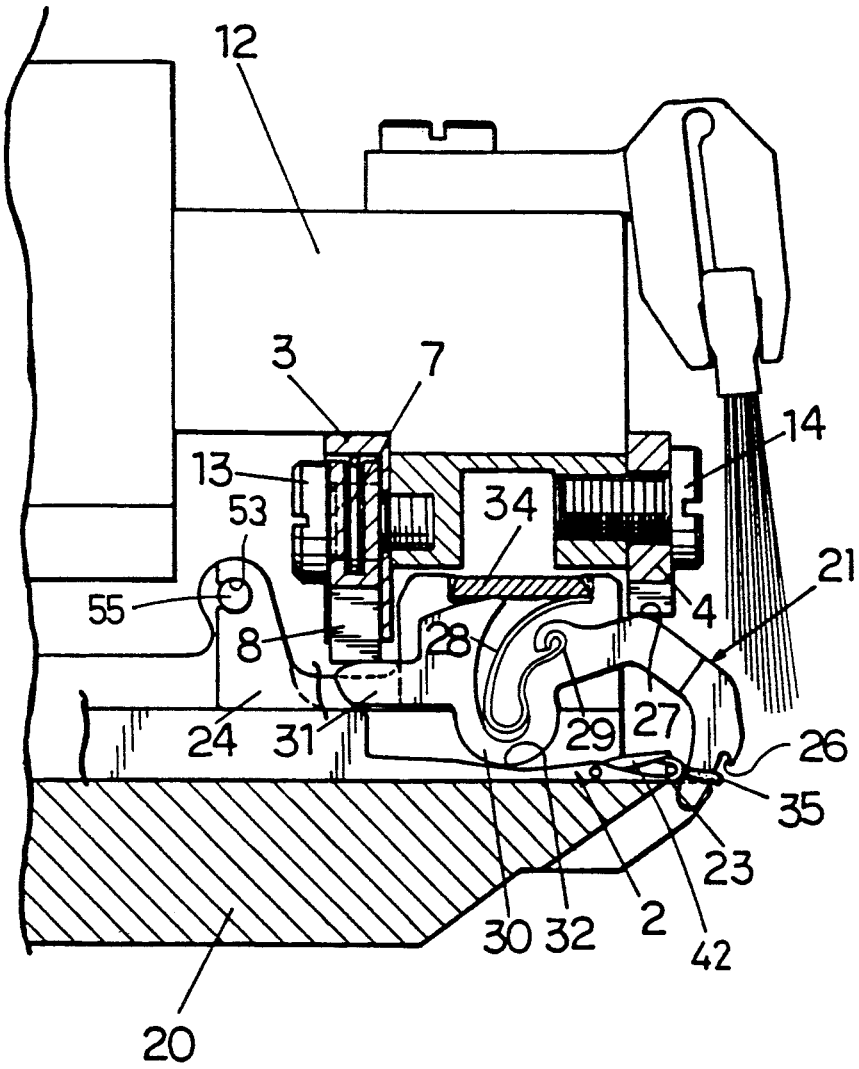
FIG. 3 is a side view of a sinker in the A—A position of FIG. 1.
Figure 4:
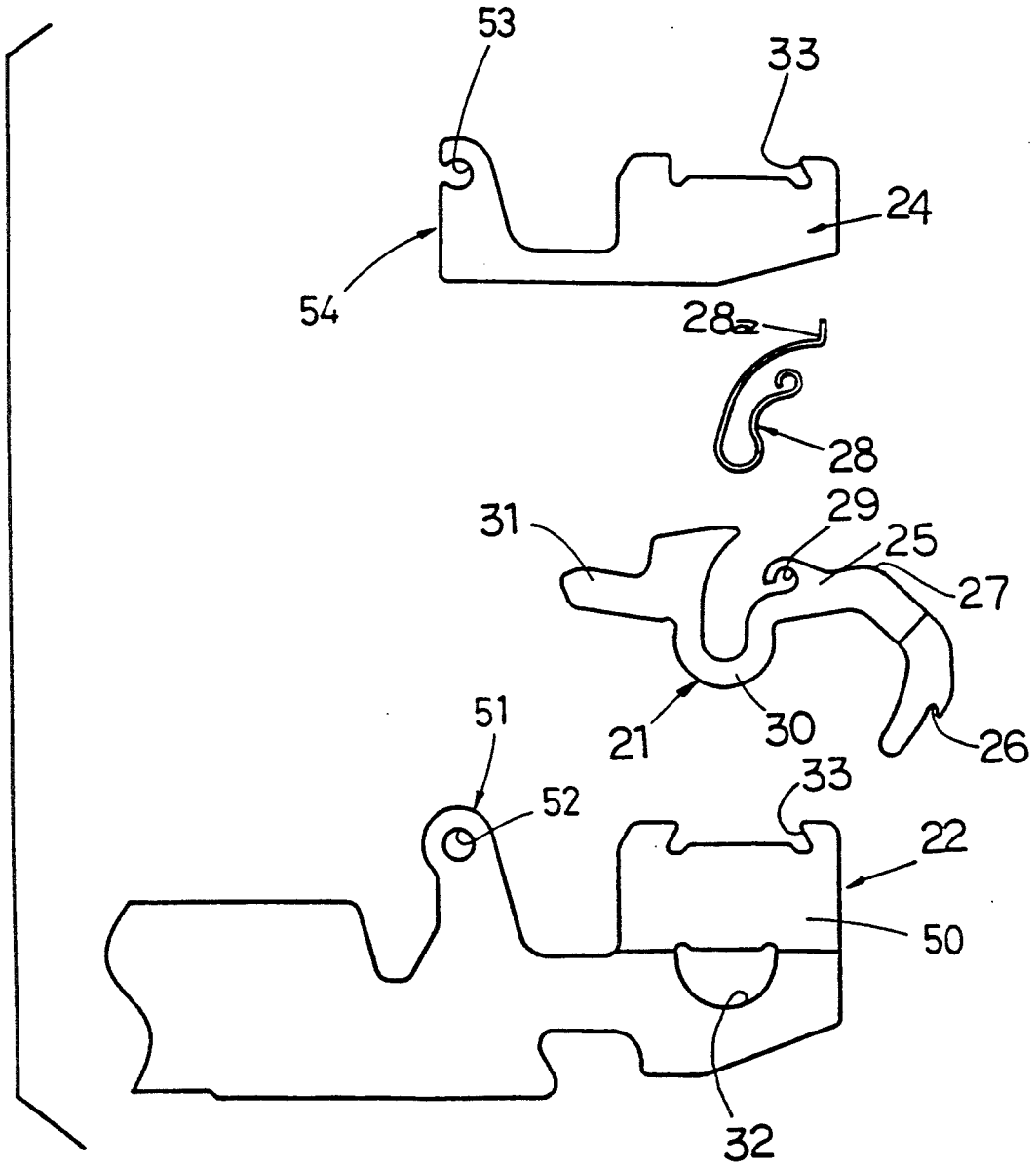
FIG. 4 shows the component parts of a sinker.

Needle plates (22) are located between knitting needles (2) as shown in FIGS. 2*a*, 2*b*, and 3 and controlled by knitting cam (1), not shown in FIGS. (2) and (3); movable sinkers (21) are placed at regular intervals above needle bed (20). Hooks (23) are formed on an end of knitting needles (2) and placed between needle plates (22) so as to move forward to and backward from the rim of needle bed (20), and spacers (24) are placed above knitting needles (2).

Each movable sinker (21) consists of thin sinker plate (25) between needle plate (22) and spacer (24) above knitting needle (2) and rocks up and down by the action of front cam (4) and rear cam (3).

Each sinker plate (25) consists of a yarn-catching hook (26) at the front end, contact surface (27), behind said hook (26), that touches sinker-controlling front cam (4); next to surface (27) is located wire hook (29) which engages one end of depressing wire spring (28) in order to lower and hold yarn-catching hook (26).

At the other end of sinker plate (25), behind wire spring hook (29), there is downward-curving semicircle (30) that serves as rotation support, and contact surface (31) that touches rear cam (3).

Needle plate (22), on which sinker plate (25) rests, consists of a cut-out portion at one end whose thickness is reduced by the thickness of sinker plate (25); underneath this cut-out portion, there is semicircular concavity (32), centered with respect to the cut-out portion, that supports downward-curving half circle (30), and the rest of the sinker can rock up and down in the slit created by the cut-out portion of needle plate (22) and spacer 24.

More specifically, needle plate (22) is made of a long thin sheet. The thickness of the upper portion of the front portion of needle plate (22) is reduced by half, leaving cut-out portion (50) at half height as shown in FIG. (4).

Because of cut-out portion (50), there is a step in the middle of needle plate (22).

Underneath cut-out portion (50), there is semicircular concavity (32), and behind cut-out portion (50) there is supporting stud (51) which almost reaches the height of groove (33) and has a transverse hole (52).

Thus, when sinker plate (25) is placed between needle plate (22) and spacer (24), and press-down plate (34) is inserted in the grooves (33) of needle plate (22) and spacer (24), spacer (24) is immobilized and, at the same time, free end (28*a*) of wire spring (28) under press plate (34) is pushed down, thereby pushing yarn-catching hook (26) of sinker plate (25) down and holding it there.

The elasticity of this wire spring is preset so that during knockover, for example, when the tension in previously formed loop (35), which is hooked and held by yarn-catching hook (26), exceeds the nominal tension, sinker plate (25) will swivel to raise the yarn-catching hook so the tension in previously formed loop (35) is kept at the nominal level. In addition, the function of spacer (24) is to prevent sinker (21) above needle plate (22) from rattling, and its thickness (width) must therefore be equal to the thickness (width) of the knitting needles.

Spacer (24) consists of arm (54) with hook (53) at its end, supported by wire (55) (see FIG. 3) which passes through hole (53) of stud (51) of needle plate (22).

Spacer (24) is above knitting needle (2) which is between the needle plates (22), and hook (53) at the end of arm (54) holds supporting wire (55) that passes through hole (52) in stud (51) of needle plate (22); the spacer can thus rotate up on supporting wire (55). Rotating sinker (21) in this manner ensures that it will move smoothly without being subjected to excess force.

Following is a description of the sinker mechanism for flat knitting machines:

In FIG. 1, when the carriage moves from right to left and sinker (21) reaches the A—A position, knitting needle (2), as shown in FIG. 3, is retracted from needle bed (20), contact surface (27) of sinker (21) touches sinker-controlling front cam (4), and contact surface (31) of sinker (21) is pushed down by movable cam (8) of rear cam (3).

Sinker plate (25) has then rotated counter-clockwise on support surface (30) which rests in semicircular concavity (32).

Figure 5:
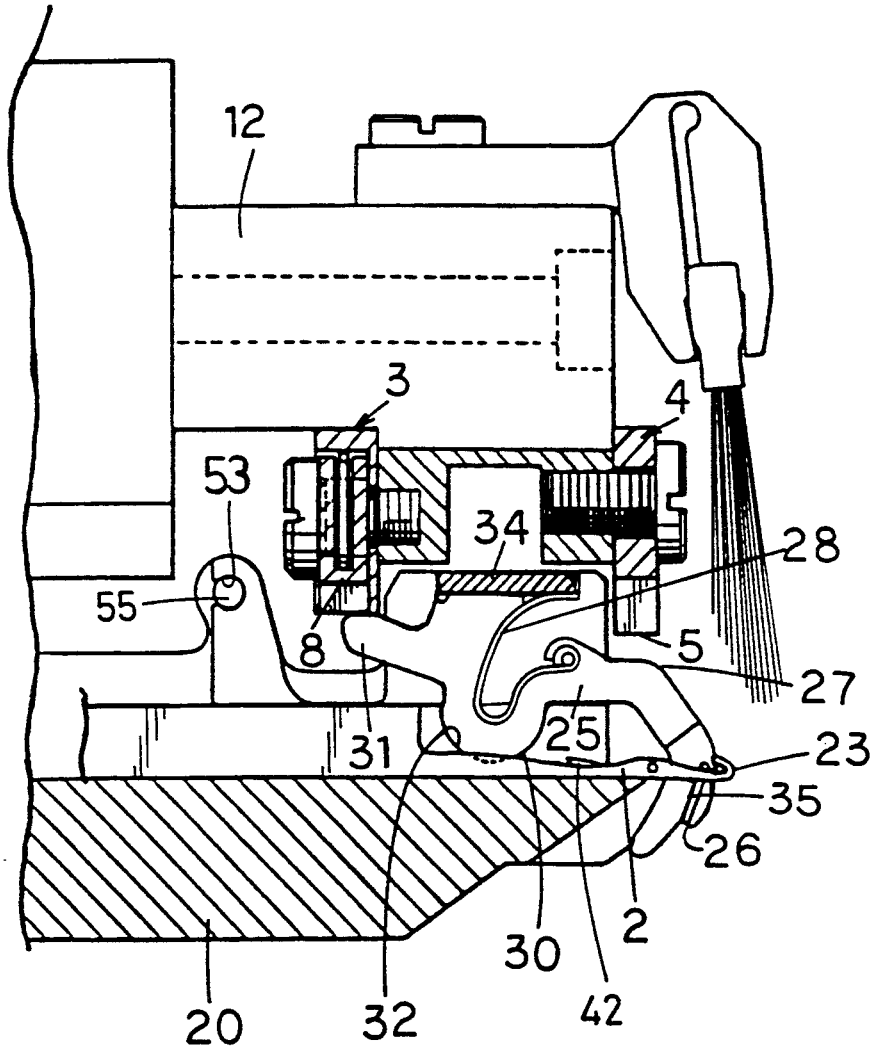
FIG. 5 is a side view of a sinker in the B—B position of FIG. 1.

When sinker (21) moves to the B—B position, butt (18) of knitting needle (2) is slightly raised by needle-raising cam (15), and hook (23) of knitting needle (2), shown in FIG. 5, is pushed out slightly beyond the rim of needle bed (20).

Meanwhile, contact surface (31) of sinker (21) is detached from movable cam (8), and sinker plate (35) is rotated clock-wise by wire spring (28) until contact surface (31) touches cam profile (6) under sinker-controlling rear cam (3), and the knitting yarn is pushed down by yarn-catching hook (26) at the front end while holding previously formed loop (35).

Figure 6:
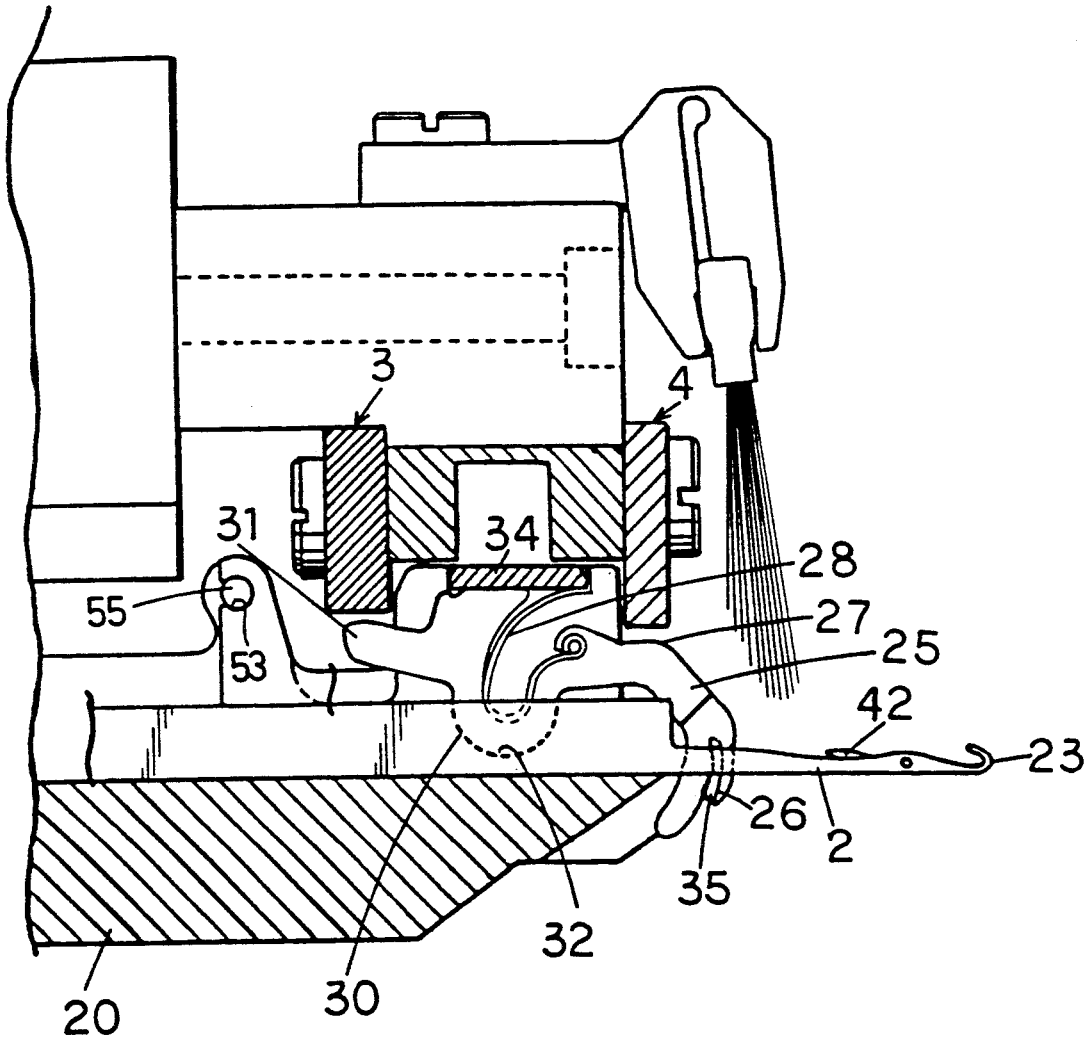
FIG. 6 is a side view of a sinker in the C—C position of FIG. 1.

When the carriage moves further left and sinker (21) reaches the C—C position shown in FIG. 1, butt (18) of knitting needle (2) is pushed all the way to the top of needle-raising cam (15), as shown in FIG. 6, and hook (23) is pushed out noticeably beyond the rim of needle bed (20).

Sinker plate (25) is now at the point where tension in previously formed loop (35) held by yarn-catching hook (26) balances the force of wire spring (28), and when it reaches the back end of knitting needle (2), the tension in previously formed loop (35) held by yarn-catching hook (26) increases considerably. The tension is eased when latch (42) of hook (23) is opened and the yarn slips over the latch. The tension is eased further as yarn-catching hook (26) moves upward, thereby maintaining the tension in previously formed loop (35) held by yarn-catching hook (26) at its nominal level.

Figure 7:
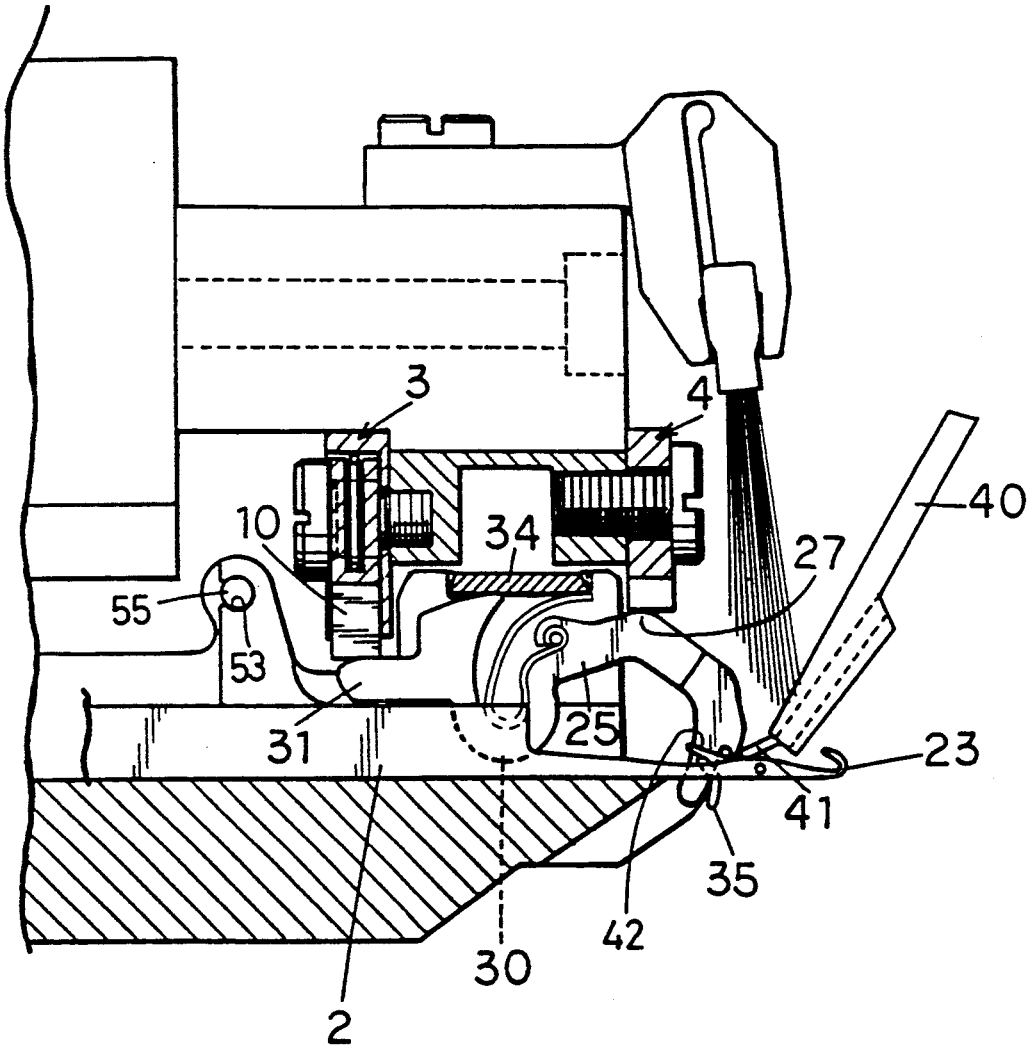
FIG. 7 is a side view of a sinker in the D—D position of FIG. 1.

When the carriage moves further left and sinker (21) reaches the D—D position, shown in FIG. 1, butt (18) of knitting needle (2) is pushed down by triangle-like cam (16), as shown in FIG. 7, while hook (23) of knitting needle (2) holds yarn (41) fed by carrier (40). At this point, rear contact surface (31) of sinker plate (25) is pushed down by movable cam (10) of rear cam (3) and, as a result, sinker (21) is rotated counter-clockwise on downward curving semicircle (30), raising yarn-catching hook (26) of sinker plate (25) almost above knitting needle (2) and preparing for knockover.

Figure 8:
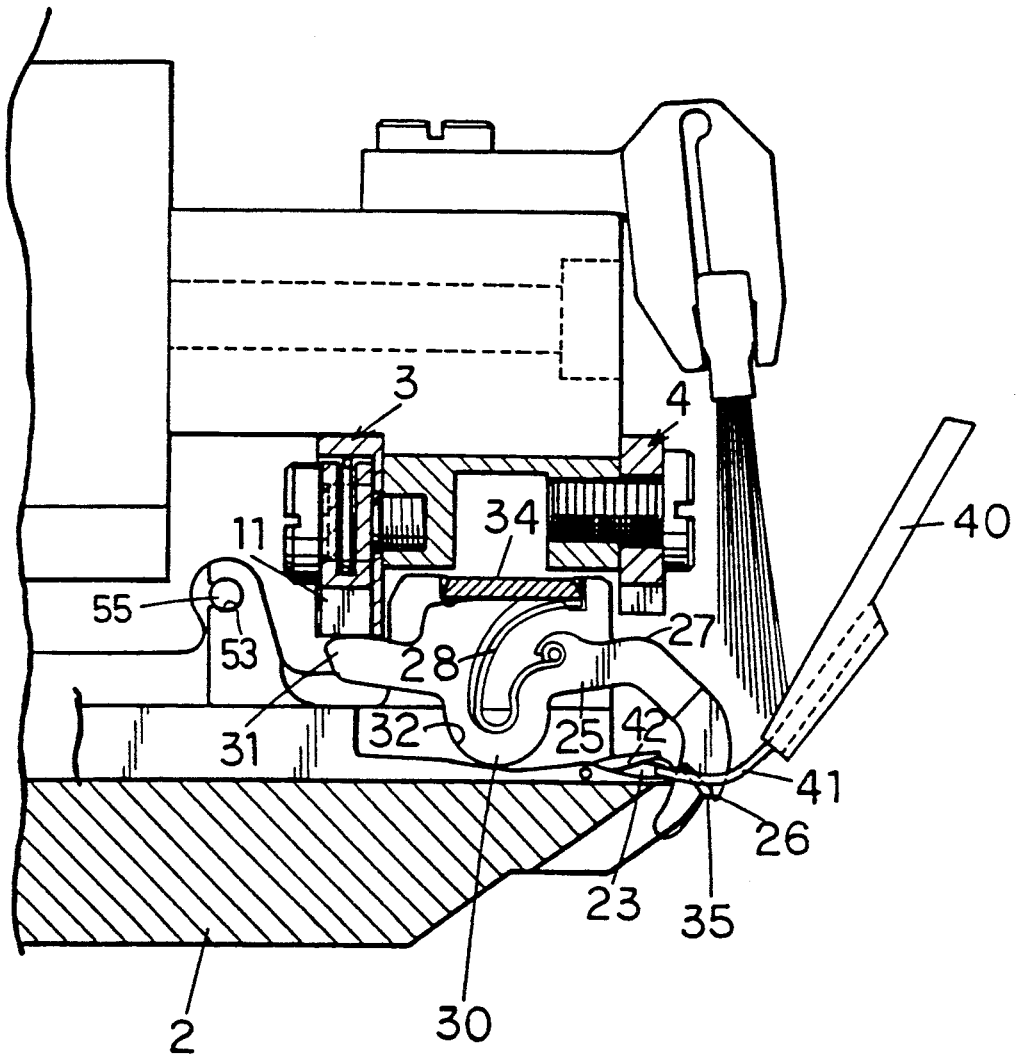
FIG. 8 is a side view of a sinker in the E—E position of FIG. 1.

When sinker (21) moves to the E—E position in FIG. 1, butt (18) of knitting needle (2) is pushed all the way down by triangle-like cam (17), retracting hook (23) completely into the needle bed (see FIG. 8).

Wire spring (28) then forces sinker plate (25) to rotate clockwise until contact surface (31) of the rear cam pushes up movable cam (11) and touches cam profile (6) underneath sinker-controlling rear cam (3), and the tip of sinker (21) is pushed below knitting needle (2) while yarn-catching hook (26) holds previously formed loop (35).

At this point, a new loop is created in hook (23) of knitting needle (2) by yarn (41) fed by carrier (40), and the size of the new loop is determined by how far knitting needle (2) moves back in relation to yarn-catching hook (26) of sinker plate (25) holding yarn (41).

In the process of moving from the D—D position to the E—E position, old loop (35) located beyond latch (42) of hook (23) closes latch (42) as knitting needle (2) pulls back, and passes over said closed latch (42).

Since the knocked-over loop is greatly stretched as hook (23) passes through it, excessive tension may be created in old loop (35) held by yarn-catching hook (26) of sinker plate (25).

This increased tension forces sinker place (25) to rotate counter-clockwise on downward curving semicircle (30) against wire spring (28) to ease the tension, thus keeping constant the tension in yarn (35) held by yarn-catching hook (26). This helps prevent breaks when yarn (41) fed by carrier (40) is of less stretchable material, such as cotton.

Figure 9:
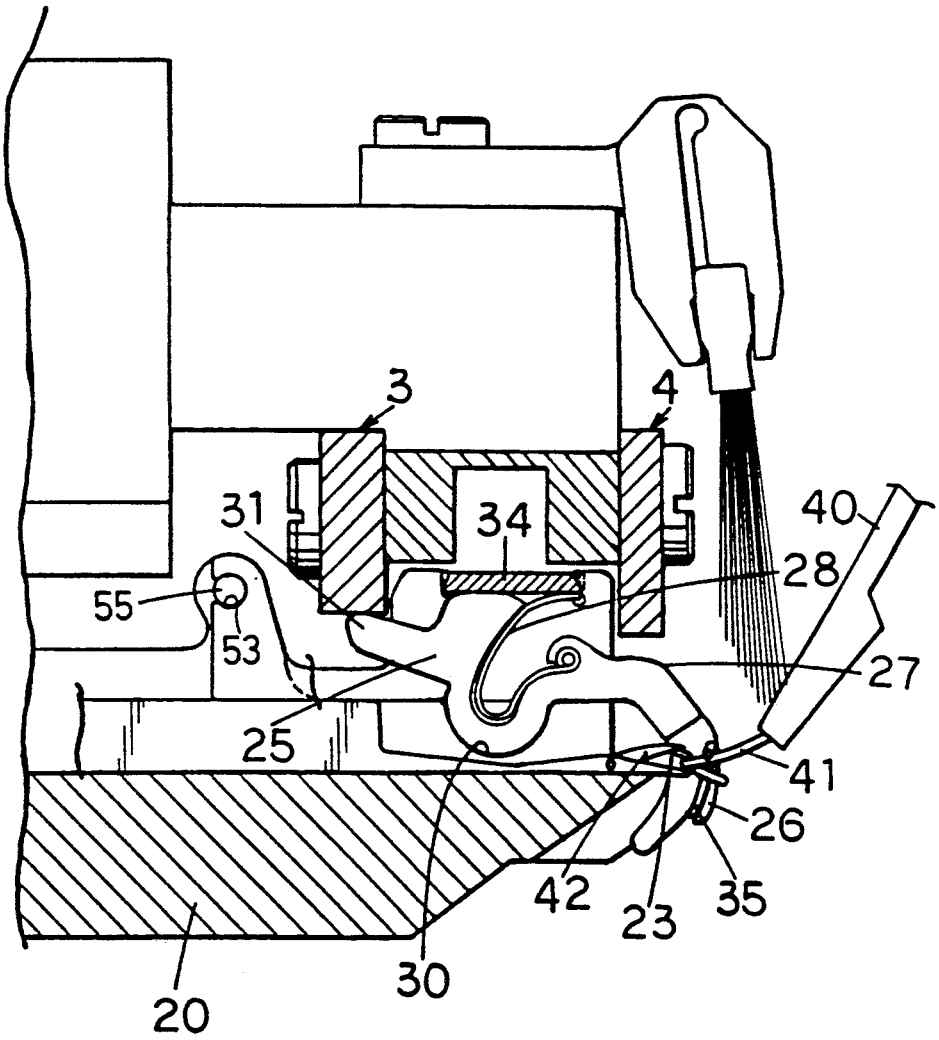
FIG. 9 is side view of a sinker in the F—F position of FIG. 1. sinker in the F—F position of FIG. 1.

When the carriage moves further left and sinker (21) reaches the F—F position shown in FIG. 1, butt (18) of knitting needle (2), is raised slightly from the E—E position, as shown in FIG. 9, at the bottom of triangle-like cam (17), and hook (23) of knitting needle (2) is then pushed out slightly beyond the rim of needle bed (20), causing slack in old loop (35) held by hook (23). But wire spring (28) prevents this slackening by pushing and holding down yarn-catching hook (26). Old loop (35) is thus held by hook (23) and prevented from dropping.

If knitting needle (2) is damaged and needs to be replaced, it can easily be taken out by pivoting spacer (24) on supporting wire (55).

In the above embodiment, wire spring (28) serves to push and hold down yarn-catching hook (26). A coiled spring may be used instead of wire spring (28), or else the sinker plate may be made of spring steel to achieve the same effect.

Although the sinker plate rests on the needle plate with the capacity to rock up and down as described in the above embodiment, it may be placed directly above the needle bed also with the capacity to rock up and down.

We claim:

1. A flat knitting machine comprising a needle bed, a plurality of parallel knitting needles slidably placed above the needle bed, each of said knitting needles including a hook on one end including a latch, a plurality of sinkers, each sinker being swingably positioned between each of said knitting needles, each of said sinkers including a sinker end, each sinker being mounted so that each of said sinkers can swing up and down between each of said knitting needles, a yarn-catching hook is formed at one end of each sinker, an individual spring is attached to each sinker so that a free end of the spring is held by a press plate to apply a downward pressure on each of said sinkers so the yarn-catching hook will drop between adjacent knitting needles, each of said springs can be easily removed from and replaced into each sinker so that each of said sinkers can be removed and replaced easily, and a downward force of the spring is adjustable so that each position of the yarn-catching hook is a function of tension in the yarn held by the hook.

2. A flat knitting machine including a needle bed, a plurality of needle plates and a plurality of knitting needles, a plurality of sinkers, wherein a thickness of an upper half of each of said needle plates is reduced by a cut-out area having a thickness of a sinker, thereby creating a step, a semicircular concavity is created under said cut-out area for recieving a downward-curving semicircle portion of the sinker, said plurality of needle plates and knitting needles are mounted in parallel on the needle bed and regularly spaced, each of said sinkers includes a yarn-catching hook on one end that positions a knitting-yarn loop, each of said sinkers includes a contact surface near the yarn-catching hook that contacts a front cam, each of said sinkers has a contact surface at another end for contacting a rear cam, each of said sinkers is located in the cut-out portion of each of said needle plates having a capability to rock up and down by use of a spring, a back end of each of said sinkers is linked to one end of each of the needle plates, the downward-curving semicircle portion has an arm that projects to contact the rear cam, a spacer is placed to have a front end adjacent a middle portion of the sinker when the sinker is joined to the needle plate, a rear end of the spacer is joined by a hook end on a support with the needle plate beside the sinker at a point above a plane of the knitting needles.

3. A flat knitting machine as set forth in claim 2, in which each of said spacers includes a downwardly extending cavity that contacts a rear cam juxtaposed a rear end that extends upwardly and the spacers are mounted to rotate upwardly when hooked by a butt end of a needle as the needle is moved upwardly.

* * * * *